United States Patent [19]

Lipschutz

[11] 4,211,096

[45] Jul. 8, 1980

[54] SECURITY LOCK WITH PISTONS AND CYLINDRICAL KEY

[75] Inventor: Paul Lipschutz, Croissy, France

[73] Assignee: Neiman S.A., France

[21] Appl. No.: 873,621

[22] Filed: Jan. 30, 1978

[30] Foreign Application Priority Data

Jan. 31, 1977 [FR] France ..... 77 02553

[51] Int. Cl.[2] ..... E05B 29/06

[52] U.S. Cl. ..... 70/364 R; 70/377

[58] Field of Search ..... 70/358, 362, 364 R, 70/364 A, 377

[56] References Cited

U.S. PATENT DOCUMENTS

| | | | |
|---|---|---|---|
| 711,376 | 10/1902 | Bayer | 70/364 A |
| 2,057,301 | 10/1936 | Golokow | 70/364 A |
| 2,283,489 | 5/1942 | Crousore | 70/364 A |
| 2,408,283 | 9/1946 | Wollin | 70/364 A |

FOREIGN PATENT DOCUMENTS

| | | | |
|---|---|---|---|
| 916694 | 8/1946 | France | 70/364 A |

*Primary Examiner*—Robert L. Wolfe
*Attorney, Agent, or Firm*—William A. Drucker

[57] ABSTRACT

The automobile security lock is of the kind having a body in which is rotatable a cylinder having pistons radially movable therein by a cylindrical key having notches formed therein. The body also has pistons which cooperate with the pistons in the cylinder. The pistons of the cylinder are slidable into radial cylindrical bores formed in the cylinder. Likewise the pistons in the body slide into radial slots in the body. On entry of the correct key the external extremities of the cylinder pistons lie flush with the external surface of the cylinder in such a manner as to permit rotation of the cylinder in relation to the body. However, on entry of an incorrect key where the corresponding notch is either insufficiently deep or too deep the extremities of the cylinder pistons enter said radial slots in said body or the internal extremities of the body pistons said radial bores in the cylinder to effect locking of the cylinder in relation to the body.

3 Claims, 4 Drawing Figures

SECURITY LOCK WITH PISTONS AND CYLINDRICAL KEY

BACKGROUND TO THE INVENTION

The invention relates to security locks with pistons and cylindrical key.

The use of cylindrical keys, in particular in the field of the automobile, offers great advantages, in particular by reason of the possibility of introducing the key in any angular position, the coupling between the key and the lock cylinder taking place in an angular position determined by the co-operation of a male profile of the key with a corresponding female profile of the cylinder.

These known locks, if they give full satisfaction, are however quite costly in manufacture by reason of the fact that, to prevent the pistons of the cylinder from dropping into the key passage in the absence of the key, these pistons of the cylinder must be equipped with a shouldered head and stop shoulders for these pistons must be formed in the radial bores of the rotor which receive these pistons. Moreover the presence of a shoulder in the radial bores of the rotor has the effect that the pistons are guided only over a short length corresponding to the smallest diameter of the bore. Poor guidance and a risk of binding of the pistons can follow.

OBJECT OF THE INVENTION

The present invention aims at eliminating these drawbacks of the known locks.

SUMMARY OF THE INVENTION

According to the invention I provide a security lock operable by a cylindrical key, comprising a body provided with an axial bore, a cylinder of cylindrical form rotatable within said axial bore and having an axial cylindrical key passage therein, piston means sliding in radial bores formed in said body, springs for urging said pistons towards the said axial bore and radially sliding within said cylinder and each co-operating, in one angular position of the cylinder in relation to the body, with the extremity of a piston means of the body, said pistons of the cylinder being constituted by flat pieces the peripheral extremity of which is shaped in accordance with a portion of the generating circumference of the said cylinder, the lateral edges of the said piece being rectilinear and parallel and its internal edge comprising a central line tangentially contacting the cylindrical key when inserted and the notches which the latter comprises, the said central line being surrounded by two abutment lines, the said flat pieces being slidable in radial slots of the cylinder of width slightly greater than that of the said flat piece, the said radial slots being of such depth that they cease in the vicinity of a diametrical plane of the cylinder, the cylinder further comprising radial cylindrical holes superimposed upon the said slots in their peripheral zone and having a diameter slightly greater than that of the pistons of the body and the body having radial slots superimposed upon the said radial bores, the internal extremities of the pistons of the cylinder being capable of penetrating line axial cylindrical passage to co-operate with notches of codes depth of a cylindrical key coupled in rotation with the said cylinder, whereupon on entry of the correct key the external extremities of the pistons of the cylinder lie flush with the external surface of the cylinder in such manner as to permit rotation of the cylinder in relation to the body, and upon entry of an incorrect key where the corresponding notch is insufficiently deep the external extremeties of the piston of the cylinder enter said radial slots relative to the body, and upon entry of an incorrect key where the corresponding notch is too deep the internal extremities of the pistons in the body enter said cylindrical holes in said cylinder to effect locking.

In the lock according to the invention, the abutment of the pistons of the cylinder is effected by co-operation of their abutment lines with the bottoms of their lodgement slots, which permits simplified manufacture and secure guidance of these pistons by co-operation of their lateral edges with the edges of the slots.

BRIEF DESCRIPTION OF DRAWINGS

The invention will be clearly understood on reading of the following description given with reference to the accompanying drawing, wherein.

DESCRIPTION OF PREFERRED EMBODIMENT

Figure 1:
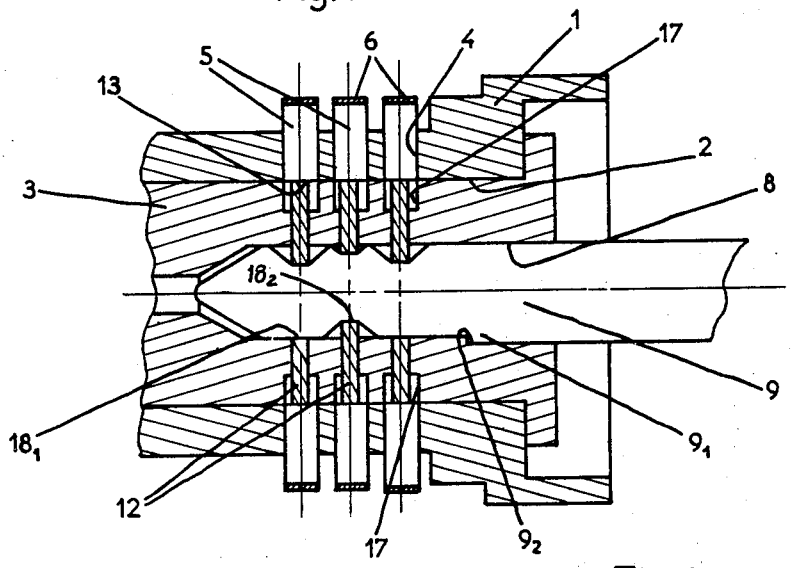
FIG. 1 is an axial sectional view of a part of a lock according to one example of embodiment of the invention.
Figure 2:
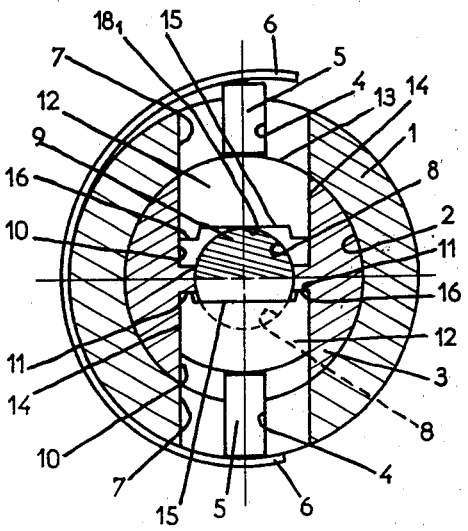
FIG. 2 is a diametric sectional view of the lock according to FIG. 1, the upper half illustrating the presence of a notch of a matching key and the lower half the absence of a key.

The lock according to the invention comprises a body 1 equipped with an axial bore 2 in which there pivots a cylinder 3 of cylindrical form. The body 1 comprises axially aligned radial bores 4 opening into the axial bore 2. Cylindrical pistons 5 are lodged each in one bore 4 and are thrust towards the interior by springs 6. Radial slots 7 (FIGS. 2 and 3) are superimposed on each of the bores 4 and comprise two parallel rectilinear edges.

The cylinder 3 comprises an axial cylindrical bore 8 intended to receive a cylindrical key 9. The key 9 is made fast in rotation with the cylinder 3 by co-operation in known manner of a male profile $9_1$ and of the key with a female profile $9_2$ of the cylinder.

The cylinder 3 comprises radial slots 10 of the same breadth as the slots 7 of the body 1, which cease in the vicinity of a diametrical plane of the cylinder. The slots 10 comprise two rectilinear lateral edges and have a width greater than the diameter of the bore 8, so as to form two stops 11 at their bottom, on either side of the bore 8.

Pistons 12 slide in the slots 10. They comprise an outer edge 13 which is a portion of the generating circumference of the cylinder 3, and two rectilinear lateral edges 14 which co-operate with the lateral edges of the slots 10 and when appropriate with those of the slots 7. The inner edges of the pistons 12 comprise a central zone 15 forming two lateral edges 16 which can bear upon the stops 11 formed at the bottom of the slots 10. Cylindrical holes 17 are further superimposed upon the slots 10 in the vicinity of their periphery.

In the locking position of the lock (lower half of FIG. 2), the key 9 is not being introduced, the slots 10 and 7 are in alignment with one another, as are the bores 4 and the holes 17. The pistons 5, under the action of their springs 6, penetrate into the bores 17, pushing the pistons 12 inwards until their edges 16 encounter the stops 11. The cylinder 3 is locked in relation to the body 1 by reason of the presence of the pistons 4 at the same time in the body and in the cylinder.

In this angular position of the cylinder 3 in relation to the body 1, the key 9 is introduced into its bore 8 and by rotation of the key the male profile $9_1$ of the key is caused to penetrate into the female profile $9_2$ of the body 1. During the introduction of the key the pistons 12 are lifted by pushing back of the pistons 5 against the action of the springs 6. The pistons 12 in the course of this movement can partially penetrate into the slots 7 of the body 1. When the key is totally introduced the pistons 12 are each in abutment upon a notch $18_1$, $18_2$ etc. of the key by tangential contact of their central zones 15. In the case of the notch $18_1$ which corresponds to the periphery of the key (top of FIG. 2), the central zone 15 is rectilinear. In the case of the notch $18_2$ (top of FIG. 3) the central zone 15 is curved. The height of the pistons 12 is such that, in this position, their outer edges 13 are flush with the surface of the cylinder, which is free to rotate in relation to the body 1.

Figure 3:
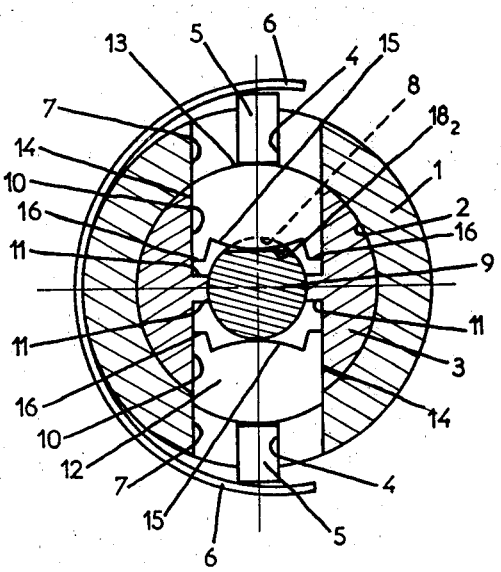
FIG. 3 is analogous with FIG. 2, the upper half being analogous with the upper half of FIG. 2, but with a different key notch, and the lower half illustrating the presence of a non-matching key.
Figure 4:
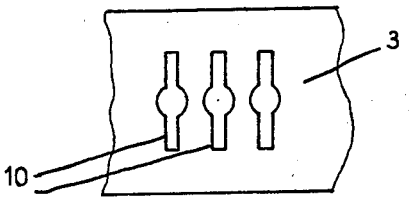
FIG. 4 is a plan view of a part of the cylinder of the lock according to FIGS. 1 to 3.

On the other hand, in the case where the key is incorrect, at least one of the notches $18_1$, $18_2$ etc does not correspond to the height of the piston 12 with which it co-operates, and the outer edge 13 of the latter is no longer flush with the surface of the cylinder 3. If the piston 12 is not sufficiently pushed out (notch too deep), it permits the corresponding piston 5 to penetrate partially into the cylinder, which is locked as in the case of absence of a key. If the piston 12 is moved out too far (notch insufficiently deep), as represented at the bottom of FIG. 3, it protrudes partially into the corresponding slot 7 of the body 1 and again locks the cylinder 3 in relation to the body 1.

I CLAIM

1. A security lock operable by a cylindrical key, comprising:

(a) a body provided with an axial bore, (b) a cylinder of cylindrical form rotatable within said axial bore and having an axial cylindrical key passage therein, (c) piston means sliding in radial bore formed in said body, (d) springs for urging said pistons towards the said axial bore and (e) pistons means radially sliding within said cylinder and each co-operating, in one angular position of the cylinder in relation to the body, with the extremity of a piston means of the body, said pistons of the cylinder being constituted by flat pieces the peripheral extremity of which is shaped in accordance with a portion of the generating circumference of the said cylinder, the lateral edges of the said piece being rectilinear and parallel and its internal edge comprising a central line tangentially contacting the cylindrical key when inserted and the notches which the latter comprises, the said central line being surrounded by two abutment lines, the said flat pieces being slidable in radial slots of the cylinder of width slightly greater than that of the said flat piece, the said radial slots being of such depth that they cease in the vicinity of a diametrical plane of the cylinder, the cylinder further comprising radial cylindrical holes superimposed upon the said slots in their peripheral zone and having a diameter slightly greater than that of the pistons of the body and the body having radial slots superimposed upon the said radial bores, the internal extremities of the pistons of the cylinder being capable of penetrating line axial cylindrical passage to co-operate with notches of coded depth of a cylindrical key coupled in rotation with the said cylinder, whereupon on entry of the correct key the external extremities of the pistons of the cylinder lie flush with the external surface of the cylinder in such manner as to permit rotation of the cylinder in relation to the body, and upon entry of an incorrect key where the corresponding notch is insufficiently deep the external extremities of the piston of the cylinder enter said radial slots in said body to effect locking of the cylinder relative to the body, and upon entry of an incorrect key where the corresponding notch is too deep the internal extremities of the pistons in the body enter said cylindrical holes in said cylinder to effect locking.

2. A lock according to Claim 1, where the said central line is rectilinear.

3. A lock according to Claim 1, wherein the said central line is curved.

* * * * *